US010424447B2

(12) United States Patent
Schneider et al.

(10) Patent No.: US 10,424,447 B2
(45) Date of Patent: Sep. 24, 2019

(54) SWITCHING SYSTEM

(71) Applicant: ELLENSBERGER & POENSGEN GMBH, Altdorf (DE)

(72) Inventors: Ewald Schneider, Offenhausen (DE); Marko Wilsdorf, Lauf a.d. Pegnitz (DE); Patric Gross, Pyrbaum (DE); Peter Meckler, Hohenstadt/Pommelsbrunn (DE); Ralf Dietrich, Altdorf (DE); Waldemar Weber, Nuremberg (DE)

(73) Assignee: Ellensberger & Poensgen GmbH, Altdorf (DE)

( * ) Notice: Subject to any disclaimer, the term of this patent is extended or adjusted under 35 U.S.C. 154(b) by 0 days.

(21) Appl. No.: 15/894,235

(22) Filed: Feb. 12, 2018

(65) Prior Publication Data

US 2018/0166236 A1 Jun. 14, 2018

Related U.S. Application Data

(63) Continuation of application No. PCT/EP2016/067464, filed on Jul. 21, 2016.

(30) Foreign Application Priority Data

Aug. 10, 2015 (DE) ..... 10 2015 215 188

(51) Int. Cl.
*H01H 1/20* (2006.01)
*H01H 9/40* (2006.01)
(Continued)

(52) U.S. Cl.
CPC ..... *H01H 33/14* (2013.01); *H01H 1/2041* (2013.01); *H01H 9/40* (2013.01);
(Continued)

(58) Field of Classification Search
CPC ..... H01H 33/14; H01H 33/08; H01H 33/53; H01H 33/62; H01H 31/14; H01H 31/16;
(Continued)

(56) References Cited

U.S. PATENT DOCUMENTS 1,749,911 A 12/1929 Todd, Jr.
1,897,316 A 2/1933 Marshall
(Continued)

FOREIGN PATENT DOCUMENTS

CN 103930962 A 7/2014
CN 203812733 U 9/2014
(Continued)

OTHER PUBLICATIONS

IPER for International Application No. PCT/EP2016/067464 with an issue date of Feb. 13, 2018.

*Primary Examiner* — Truc T Nguyen
*Assistant Examiner* — William A Bolton
(74) *Attorney, Agent, or Firm* — Muncy, Geissler, Olds & Lowe, P.C.

(57) ABSTRACT

A switching system, in particular of an on-board electrical system of a motor vehicle having a first disc which has a first, a second, a third, and a fourth stationary contact. The second and the third stationary contact, are electrically contacted by a first contact bar of the first disc. The switching system also has a second disc which has a first, a second, a third, and a fourth movable contact. The first and the second movable contact are electrically contacted by a second contact bar of the second disc, and the third and the fourth movable contact are electrically contacted by a third contact bar of the second disc. The second disc is rotationally mounted about a rotational axis relative to the first disc,
(Continued)

wherein all the contacts are electrically connected in series in an angular position. A circuit breaker is also provided that includes a switching system.

18 Claims, 2 Drawing Sheets

(51) Int. Cl.

| | |
|---|---|
| ***H01H 33/08*** | (2006.01) |
| ***H01H 33/14*** | (2006.01) |
| ***H01H 33/53*** | (2006.01) |
| ***H01H 71/16*** | (2006.01) |
| ***H01H 71/08*** | (2006.01) |
| ***H01H 73/30*** | (2006.01) |

(52) U.S. Cl.
CPC ..... *H01H 33/08* (2013.01); *H01H 33/53* (2013.01); *H01H 71/16* (2013.01); *H01H 73/30* (2013.01); *H01H 2071/088* (2013.01)

(58) Field of Classification Search
CPC .. H01H 2031/286; H01H 1/2041; H01H 9/40; H01H 71/16; H01H 73/30; H01H 73/08
USPC ..... 218/4–8; 200/17 R, 179, 1 R; 335/10
See application file for complete search history.

(56) References Cited

U.S. PATENT DOCUMENTS

| | | | | |
|---|---|---|---|---|
| 4,145,585 | A * | 3/1979 | Iwasaki | H01H 19/005 200/11 DA |
| 4,952,897 | A * | 8/1990 | Barnel | H01H 3/222 335/147 |
| 6,265,681 | B1 * | 7/2001 | Aromin | H01H 19/54 200/570 |
| 8,350,168 | B2 * | 1/2013 | Faik | H01H 1/2041 200/244 |
| 8,658,923 | B2 | 2/2014 | Weber et al. | |
| 9,431,197 | B2 | 8/2016 | Engewald | |
| 9,653,232 | B2 | 5/2017 | Weber et al. | |
| 2012/0000753 | A1 | 1/2012 | Faik | |
| 2014/0110376 | A1 * | 4/2014 | Zahlmann | H01H 1/2041 218/4 |
| 2014/0246403 | A1 * | 9/2014 | Engewald | H01H 1/2041 218/26 |

FOREIGN PATENT DOCUMENTS

| | | | |
|---|---|---|---|
| CN | 104078264 | A | 10/2014 |
| CN | 104269309 | A | 1/2015 |
| DE | 495 357 | C | 4/1930 |
| DE | 910 4076 | U1 | 7/1991 |
| WO | WO 2010/037424 | A1 | 4/2010 |

* cited by examiner

SWITCHING SYSTEM

This nonprovisional application is a continuation of International Application No. PCT/EP2016/067464, which was filed on Jul. 21, 2016, and which claims priority to German Patent Application No. 10 2015 215 188.3, which was filed in Germany on Aug. 10, 2015, and which are both herein incorporated by reference.

BACKGROUND OF THE INVENTION

Field of the Invention

The invention relates to a switching system, which can be a component of, for example, an on-board electrical system of a motor vehicle. The invention further relates to a circuit breaker having such a switching system.

Description of the Background Art

Motor vehicles typically have a variety of electrically powered components, for example power windows, seat adjustments or air conditioners. Due to the increasing energy demand of such auxiliary units, it is necessary to provide an on-board electrical system which can carry this increased energy flow. Typically, the electrical voltage carried by the on-board electrical system is a DC voltage of substantially 12 volts. To also provide a relatively large flow of energy, consequently, it is necessary to increase the electric current carried by the cable harnesses of the on-board electrical system. As a result, a comparatively large cross section of each of the harness-forming power lines is required, which on the one hand increases the weight and on the other hand, the manufacturing cost. Due to the increased weight, the efficiency of the motor vehicle is reduced.

An alternative thereto provides increasing the electrical voltage of the on-board electrical system so that sufficient electrical energy is provided even with a comparatively low current flow. Here, the electrical voltage is increased to 48 volts so that with the same energy flow, the current is only a quarter of a current carried in a 12-volt on-board electrical system. Due to the increased electrical voltage, however, mechanical switching of the current flow results in the formation of an arc. Such a problem occurs to a lesser extent in a 12-volt electrical system because in a mechanical switch, typically, the conventional switching path is several microns, which substantially corresponds to the arc voltage of 12 volts. In other words, the arc itself is extinguished due to the extension of the arc by means of the switching contacts. To ensure secure switching of elevated electrical voltages, it is therefore necessary to increase the switching path, which leads to an increased space requirement for the switch. In addition, the current flow persists comparatively long due to the longer switching path and thus the increased duration until the arc is extinguished. In particular, in the event of failure or an accident, relatively fast switching is required.

SUMMARY OF THE INVENTION

It is therefore an object of the invention to provide a switching system, in particular an on-board electrical system of a motor vehicle, as well as a particularly suitable circuit breaker with a switching system, wherein expediently, the likelihood of arc formation is reduced and advantageously, switching time is shortened.

The switching system is used to interrupt a flow of electrical current. In other words, the switching system is an electrical and/or electronic switching system. The switching system is preferably a component of an on-board electrical system of a motor vehicle. In particular, the on-board electrical system comprises an electrical voltage of 48 volts. For example, the switching system is suitable for use in an on-board electrical system of a motor vehicle. Conveniently, the switching system is provided and configured to be used in an on-board electrical system of a motor vehicle.

The switching system comprises a first and a second disk, wherein said second disk is mounted rotationally about an axis of rotation, relative to the first disk. In other words, it is possible to pivot the second disk relative to the first disk. In particular, the rotational axis extends through the second disk. Preferably, the first disk is rotationally mounted, and only the second wheel is pivotable. For example, mounting is realized by means of a sliding bearing. For example, a rotational movement is restricted by means of a stop. In particular, the second disk is rotatable relative to the first disk by at least 5°, 10°, 15°, 20°, 30° and/or less than 60°, 50° or 45°, and for example, by up to 10°, 15°, 20° or 45°.

The first disk has a first, a second, a third and a fourth stationary contact, which are, for example, similarly designed, and in particular each comprise a metallic cylinder. The stationary contacts are spaced apart from each other. Conveniently, the stationary contacts are made from an electrical conductor such as a metal, for example copper. The second disk comprises a first, a second, a third and a fourth movable contact. The movable contacts are also spaced apart from each other and in particular, are designed in each case similarly to the stationary contacts of the first disk. In this way, a relatively large number of identical parts can be used in production. The contacts, i.e., the stationary contacts and the movable contacts, are advantageously made of a material that is designed to carry an electrical current and is therefore suitably and advantageously provided to carry an electric current, and that is in particular comparatively resistant to melting loss. In other words, the risk of damage due to an arc, i.e., a plasma formed on the surface of the contacts, is comparatively low.

The switching system further includes a first, a second and a third contact bar, which are made suitably of an electrically conductive material, in particular a metal, for example, copper. For example, the contact bars, at least one of the contact bars, is a cable or a lead frame. Particularly preferred, however, one of the contact bars, and preferably all contact bars, are formed by a metal strip. The first contact bar is a component of the first disk and the second stationary contact and the third stationary contact electrically contact one another by means of the first contact bar. In other words, the second and the third stationary contact are connected in series by means of the first contact bar. In particular, the second stationary contact rests mechanically directly on the first contact bar and the first contact bar rests mechanically directly on the third stationary contact. For example, the two stationary contacts are soldered or welded to the first contact bar.

The second and the third contact bar are part of the second disk, and the first and the second movable contact electrically contact each other by means of the second contact bar, wherein said second contact bar preferably rests directly mechanically on the first and second movable contact and is preferably secured thereto, for example by means of soldering or welding. The third and fourth movable contact electrically contact each other by means of the third contact bar, wherein said third contact bar is preferably fixed to the third and fourth movable contact. Preferably, the contact bars are fixedly connected with the respective contacts, in particular, non-releasably. In particular, no further contacts directly electrically connect with the contact bars. In summary, the first and second movable contact electrically connect in series by means of the second contact bar, and the third and fourth movable contact electrically connect in series by means of the third contact bar.

In an angular position of the second disk relative to the first disk, i.e., at a rotation of the second disk about the rotational axis until the position of the second disk corresponds to the angular position relative to the first disk, all contacts are electrically connected in series. Consequently, an electric current flow is made possible by means of the switching system, wherein the current is carried by all contacts, i.e., all movable contacts and all stationary contacts. In the angular position and in the series circuit, in particular, the contacts electrically contact each other at low impedance. In other words, an electric current flow across all the contacts is made possible even at a comparatively low electrical voltage of, for example, 0.1 volts.

With a further rotation of the second axis about the rotational axis, the angle between the first disk and the second disk is changed and thus, the angular position is canceled. Preferably, in this case, i.e., if the angular position does not exist, all the contacts are no longer connected in series. In particular, in this case, only the electrical contacting is provided by means of the contact bars. Preferably, however, there is no electrical connection between the first disk and the second disk. In other words, the movable contacts are electrically isolated from the stationary contacts. As a result, the current path is interrupted by a rotational movement of the second disk at a number of points, in particular, at least four points, so that a number of arcs are formed. Thus, an arc is needed in the area of each interruption so that the electric current continues to flow through the switching system.

In summary, during a rotational movement caused by arcs forming between the contacts, the series circuit is initially further preserved. Because of the number of arcs, a comparatively large electrical voltage is required to maintain the arcs. Here, however, the arc voltage is increased, which on the one hand, is determined based on the spatial length of the arcs, and on the other hand, is formed due to the comparatively large number of contacts, the so-called contact voltage. Thus, even at an electrical voltage of substantially 48 volts, at least one of the arcs is interrupted with a comparatively small rotation of the second disk relative to the first disk, which is why the remaining arcs also extinguish due to the series connection of the arcs.

Conveniently, the first and fourth stationary contact respectively electrically contact a connector. Thus, in the angular position, a current flow is made possible between the first stationary contact and the fourth stationary contact, and between the connectors, for which purpose the electric current is conducted across all contacts. In other words, all contacts are connected in series with the two connectors. Advantageously, the switching system does not include a permanent magnet and/or electromagnet. In other words, the switching system is free of magnets, in particular permanent magnets, which reduces the manufacturing cost. For example, the movable contacts are arranged symmetrically relative to the rotational axis, for example point-symmetrically or rotationally symmetrically, which simplifies manufacture. Alternatively or in combination therewith, the stationary contacts are arranged symmetrically, for example also with respect to the axis of rotation or the center of the first disk, for example, point-symmetrically or rotationally symmetrically. For example, in each case at least two of the contacts are arranged diametrically to the respective center.

For example, the first stationary contact and the first movable contact can directly electrically contact each other in the angular position. In particular, no further contact is arranged between the first stationary contact and the first movable contact, and preferably, the first stationary contact rests directly on the first movable contact. In other words, the first stationary contact is in direct mechanical contact with the first movable contact. Further, in the angular position, the second stationary contact directly electrically contacts the second movable contact, and the third stationary contact also directly electrically contacts the third movable contact. The fourth stationary contact also directly electrically contacts the fourth movable contact, wherein expediently, the direct electrical contact is in each case realized by means of direct mechanical contact.

Thus, in the angular position, a current flow is made possible from the first stationary contact to the first movable contact, from the first movable contact via the second contact bar to the second movable contact, from the second movable contact to the second stationary contact, from the second stationary contact via the first contact bar to the third stationary contact, from the third stationary contact to the third movable contact, from the third movable contact via the third contact bar to the fourth movable contact and from the fourth movable contact to the fourth stationary contact, so that all contacts are connected in series. If the angular position is modified, each of the stationary contacts is conveniently spaced apart from the respective associated movable contact so that all the movable contacts are separated from all the stationary contacts. As a result, in each case, an arc is formed between the first stationary contact and the first movable contact, between the second stationary contact and the second movable contact, between the third stationary contact and the third movable contact and between the fourth stationary contact and the fourth movable contact, which are thus connected in series. In this way, four arcs are generated during a switching process which is carried out by means of a rotation of the second disk about the rotational axis. Thus, the arc voltage is increased, i.e., the electrical voltage which is required so that there continues to be a current flow, despite the shifting movement caused by the arcs forming. Further, the length of the arcs is extended when the second disk is rotated, which is why the arc voltage rises with the increasing variation in the angular position.

Preferably, in the angular position, the respective contacts only rest against one another. In particular, no positive fit or adhesion between them is created, so no great effort is required to carry out the switching. Also, snagging of the individual contacts is excluded. Advantageously, the contacts are designed in the manner of a disk.

For example, the rotational axis is perpendicular to the second disk such that the disk remains substantially in one plane, even upon execution of a rotation movement of the second disk. As a result, the space requirement is reduced. Advantageously, the rotational axis intersects the second disk substantially in the center and/or in its center of gravity, which is why the formation of an unbalance is prevented. Alternatively, or more preferably in combination herewith, the first disk is parallel to the second disk. As a result, during a rotational movement and therefore a change in the angular position, the second disk is not lifted from the first disk. Rather, the two disks are rotated against each other. Thus, the space requirement does not change even with a change in the angular position.

Furthermore, during a rotational movement, the arcs are in mechanical contact with at least one of the disks, which at least partially cools these and thus increases their electrical resistance and therefore the arc voltage. Also, a relatively rugged switching system is provided in this way, and inadvertent movement of the second disk in the angular position, in which all the contacts are connected in series, is substantially prevented, which is why the possibility of unintentionally switching the switching system on can be ruled out.

Preferably, the second disk has a disk body that is made in particular of an electrical insulator such as a plastic or a ceramic. The second and third contact bars are advantageously located on the side of the disk body of the second disk that is located opposite the first disk. In other words, the disk body of the second disk is positioned between the two contact bars and the first disk, which is why a short circuit between the two contact bars and components of the first disk can be ruled out, even with a rotation of the second disk about the rotational axis. The movable contacts are in this case preferably located on the side of the disk body facing the first disk side, and the electrical contact with the two contact bars is effected, for example, by means of a plated-through hole through the disk body, which in particular has a suitable recess for this purpose, within which are positioned either components of the contact bars or of the movable contacts, or an electrical conductor.

For example, the disk body comprises four recesses, wherein one of the movable contacts is positioned within each of the recesses. In this way, a separation of the movable contacts due to rotation is substantially excluded. In particular, the movable contacts are in this case circumferentially at least partially enclosed by the disk body, for example, in a form-fitting manner, which further improves the connection. In particular, the movable contacts are substantially fully embedded and are aligned with the disk body so that the second disk has a planar surface on the side facing the first side. In other words, the movable contacts are flush with the surface of the disk body. Thus, the possibility of snagging when the second disk is rotated is substantially eliminated. Also, damage to the movable contacts and an accumulation of dirt particles are avoided, such as those incurred due to melting loss, which would reduce electrical conductivity.

For example, the first disk is similarly designed as the second disk. In other words, the first disk has a disk body, wherein the disk body of the first disk is preferably positioned between the second disk and the first contact bar. Alternatively or in combination therewith, the stationary contacts are located in recesses of the disk body of the first disk, which is preferably made of an electrical insulator such as a plastic or a ceramic. Conveniently, the first disk has a planar surface on the side facing the second side. Particularly preferably, the two sides of the first and second disks facing each other are planar, so that these lie substantially fully flat against each other. During a rotational movement of the two disks relative to each other about the axis of rotation, snagging or jamming is therefore excluded. In addition, the space available for the dispersal of the arcs is limited and is only formed by means of the existing gap between the two disks. Consequently, electric resistance of the arcs is further increased and the arcs are in direct mechanical contact with the two disks and are thus cooled relatively efficiently. Particularly preferably, the disk bodies are made of an arc-resistant and/or melting-loss resistant material.

For example, the second disk is spring-loaded, wherein preferably, the disk is driven to a rotary movement about the axis of rotation by means of the spring. In the relaxed state of the spring, either all contacts are connected in series or a series connection is canceled. Particularly preferably, the series connection is canceled so that an electric current flow is possible only by applying a counter-force against the spring force, therefore substantially preventing an unintended flow of electric current. More preferably, the switching system, such as the second disk, comprises a stop by means of which rotational movement about the axis of rotation is limited, in particular, despite the spring loading. Consequently, the second disk is pressed against the stop by the spring, so that when the second disk is rotated about the rotational axis, a relatively large force is always present, leading to increased rotational speed of the second disk and thus reducing the time required to change the angular position. For example, the second disk has a pin which is spaced from the axis of rotation and on which the spring is articulated, in particular, to which the spring is connected. Conveniently, the spring is a torsion spring or a leg spring which is wound around the rotational axis, and which has at least one leg that rests in particular against the pin. In this way, production cost is reduced.

The switching system can comprise a latching mechanism for the second disk, by means of which the second disk can be latched. In particular, the second disk has a recess, for example, on the circumferential side, within which a retaining element of the latch is at least partially positioned for locking the second disk. For example, the latch has a component made of a bimetal, in particular, a bimetallic strip or bimetallic snap disk, so that the latch is released with a thermal change. For example, the second disk is latched in the angular position, in which the contacts are electrically connected in series. Consequently, an interruption of the electrical current flow is possible only upon release of the latch. Particularly preferred, the second disk is spring-loaded so that upon release of the latch, the second disk is rotated about the rotational axis by at least a certain angle from the angular position, leading to an interruption in the electric current flow.

Conveniently, the switching system has a housing within which the first and second disks are positioned, protecting these from damage. An accidental electrical contact between components and contact bars or contacts of the switching system is also prevented by means of the housing, which enhances reliability. For example, the connector electrically connected to the first stationary contact projects from the housing through a slot and/or the connector electrically contacting the fourth stationary contact also projects from the housing through a slot, provided that the connectors are available. Consequently, only two current-carrying components of the switching system are led out of the housing, further increasing operational safety. In particular, the two connectors are optimized for their respective purpose of use, for example, the integration in an on-board electrical system of a motor vehicle.

The housing can comprise a housing shell which is configured in particular cup-shaped. Further, the housing includes a housing cover, which in particular is planar. In this way, manufacture and assembly are simplified. For example, the housing shell and the housing cover are made of an electrical insulator, in particular a plastic material by means of a plastic injection molding process. In particular, the housing cover and the housing shell are welded together so that the ingress of foreign particles in the switching system can be ruled out.

For example, the first disk is substantially designed similarly to the second disk, and can therefore be produced independent of the housing. More specifically, the first bar and the second bar only differ due to the number of contact bars and/or the position of the contact bar, so that a relatively large number of equal parts may be used to create the switching system. In an alternative, the first disk is formed by the housing shell, in particular, the bottom of the housing shell, i.e., of at least one housing wall. Consequently, the housing shell has the stationary contacts and the contact bar, which are inserted, for example, in a mold for purposes of manufacturing and are at least partially injection-molded around with plastic material to create the housing shell.

For example, the housing shell can have an axis journal which is in particular integrally formed on a bottom of the housing shell. In particular, the housing shell is integrally formed. The second disk is mounted on the journal, which advantageously centrally has a recess, within which the axle journal is disposed in particular with a clearance fit. Consequently, the axle journal is radially surrounded by the second disk. The axle journal is used to mount the second disk so that it can be rotated about the, in particular, fixed journal to change the angular position. In particular, the journal is concentric to the second disk, and in particular, parallel and/or concentric to the axis of rotation. Specifically, the journal is connected with its free end to the bottom of the housing wall.

Provided that the first disk is configured as a component separate from the housing, this also can comprise a central recess and is mounted on the axle journal. For example, the axle journal has a spring-like extension (spring) which engages in a corresponding groove of the first disk to prevent a rotational movement around the axle journal. Alternatively, after positioning on the journal, the first disk is connected with further components of the housing to prevent rotational movement. For example, pins are attached to the housing bottom, in particular integrally formed, which engage in corresponding receptacles of the first disk. For example, a spring element, in particular a spiral spring, is arranged on the side of the second disk opposite the first disk, which expediently is mounted likewise on the axle journals. In the mounted state, the spring element is supported in particular both on the second disk and on the housing cover. By means of the spring element, an axial preload of the second disk is created, which is why the second disk is always in direct mechanical contact with the first disk. Consequently, the flow of electric current is provided in the angular position, wherein the electrical resistance is relatively low.

In particular, the switching system includes an actuating mechanism, by means of which the second disk can be rotated about the rotational axis. The actuating mechanism comprises, for example, a cylinder, which suitably projects from the housing, if one is provided. In particular, the cylinder engages with the second disk, in particular a radially outwardly offset pin, preferably by means of a triangular contour, by means of which a linear movement of the cylinder is transformed into a rotational movement of the second disk.

The circuit breaker includes a switching system comprising a first disk having a first stationary contact and a second stationary contact and a third stationary contact and a fourth stationary contact, wherein said second and third stationary contacts electrically contact each other by means of a first contact bar of the first disk, in particular directly. The switching system further includes a second disk, comprising a first movable contact and a second movable contact and a third movable contact and a fourth movable contact, wherein the first and the second movable contacts electrically contact each other, in particular directly, by means of a second contact bar of the second disk, and the third and fourth movable contact are contacted by means of a third contact bar of the second disk. The movable contacts are spaced apart from each other, and the stationary contacts are also spaced apart from each other. The second disk is mounted rotationally about an axis of rotation relative to the first disk, wherein all the contacts are electrically connected in series in an angular position.

The circuit breaker comprises, for example, a voltage sensor or, in particular, a current sensor, by means of which an overcurrent is detected. For example, the current sensor comprises a bimetallic strip, which is in particular a component of a latch, by means of which the second disk is held in the angular position. For example, the bimetallic strip is part of one of the contact bars. In the event of an overcurrent, the bimetallic strip is heated and consequently bent, releasing the latch. In particular, in this case the second disk is spring-loaded so that upon release of the latch, this second disk is rotated about the rotational axis by at least a certain angle. The angle is preferably greater than 5°, 10°, 15°, 20°, 30° and/or less than 60°, 50° or 45°.

As a result, the contacts are spaced apart from each other, which is why an arc forms between the movable contacts and the respective stationary contacts. Here, the arcs are spaced apart from the bimetallic strips so that it is not damaged due to the melting loss caused by the arcs, which increases operational reliability. In addition, a comparatively large number of release operations is possible. For example, the circuit breaker includes an actuating device by means of which the second disk can be rotated to the angular position in which the contacts are connected in series. In particular, a latching of the second disk is carried out in the angular position. The circuit breaker is in particular a component of an on-board electrical system of a motor vehicle and expediently has suitably shaped connectors, which correspond in particular to those of a fuse box of an automobile. In particular, the circuit breaker is provided and configured for switching electrical voltages between 45 and 50 volts.

The invention further relates to a vehicle electrical system with such a switching system which is, for example, part of a relay or a circuit breaker.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
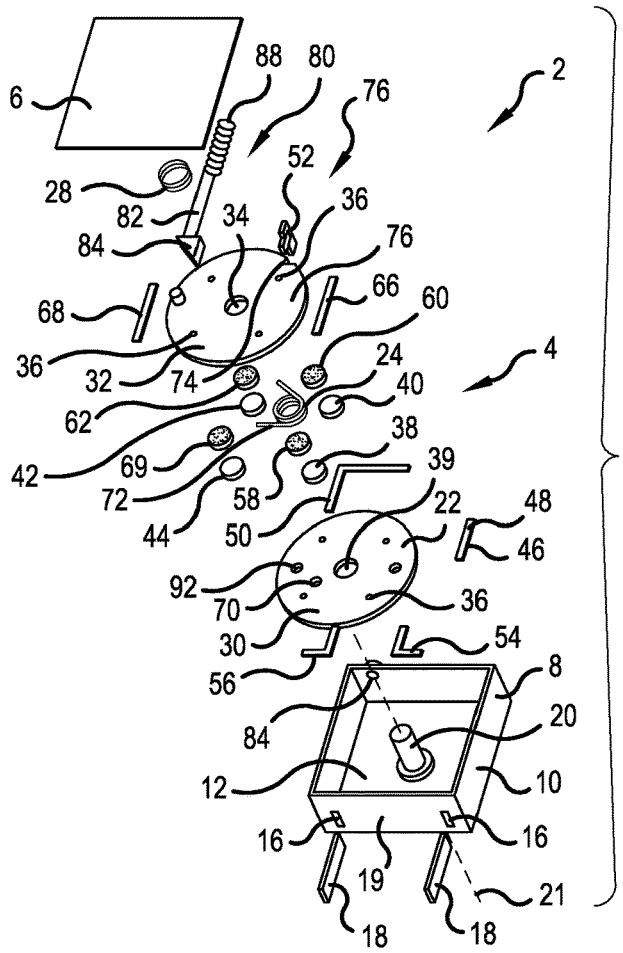
FIG. 1 is an exploded view of a circuit breaker comprising a switching system.
Figure 2:
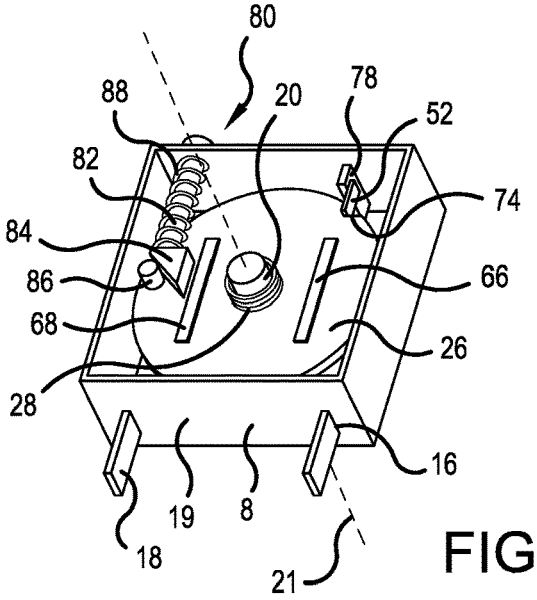
FIG. 2 illustrates, in part, the assembled circuit breaker.

In FIG. 1, a circuit breaker 2 is illustrated in an exploded view, and in FIG. 2, in an assembled view, which is provided to switch an electrical voltage of 48 volts within an on-board electrical system of a motor vehicle. The circuit breaker 2 includes a switching system 4 having a housing 10 comprising a housing cover 6 and a housing shell 8. The housing cover 6 not shown in FIG. 2 and the housing shell 8 are each integrally made of a plastic material by means of injection molding and made of an electrically non-conductive material. The housing shell 8 is cup-shaped and comprises a housing bottom 12 and housing walls 14 circumferentially surrounding the latter. One of the housing walls 14 has two slots 16, within which in each case a connector 18 is arranged in the form of a disk which extends partially into the interior of the housing 10. In this case, the connectors 18 form the contact-connection of the circuit breaker 2 and are adapted for a corresponding switch box of the motor vehicle, which in particular has a corresponding receptacle for these connectors 18.

An axis journal 20 is formed on the housing bottom 12, which is concentric with and parallel to a rotational axis 21. The journal 20 itself, however, is rotationally fixed to the housing bottom 12. The remaining free end of the journal 20 is supported in the mounted state on the housing cover 6, which is welded to the housing shell 8. Mounted on the axle journal 20 are a first disk 22, a torsion spring 24 and a second disk 26, wherein the leg spring 24 is positioned between the two disks 22, 26. Consequently, the first and second disks 22, 26 and the leg spring 24 are positioned within the housing 10. The first disk 22 is disposed between the leg spring 24 and the housing bottom 12. The first disk 22 is non-rotationally supported on the axle journal 20, whereas the second disk 26 is rotatably supported around the axle journal 20. Here, the second disk 26 is arranged perpendicular to the axis of rotation 21 and parallel to the first disk 22.

Further, a spring element 28 in the form of a spiral spring, which is supported both on the second disk 26 and on the cover 6, is mounted on the axle journal 20. By means of the spring element 28, a mechanical contact is ensured between the first and second disks 22, 26. In other words, the spring element 28 serves to axially bias in one direction, parallel to the rotational axis 21, wherein, however, the applied force by the spring element 28 is comparatively low.

Both the first disk 22 and the second disk 26 each comprise a disk body 30, 32 made of an electrically non-conductive material, in particular a plastic or a ceramic. The disk bodies 30, 32 each have a substantially circular cross section, perpendicular to the axis of rotation 21. In the center, each of the two disk bodies 30, 32 have a central recess 34, within which the axle journal 20 is positioned in the assembled state. Four contact pins 36 made of an electrically conductive material such as copper are embedded in each of the disk bodies 30, 32 in the axial direction, i.e., aligned parallel to the rotational axis 21 and arranged rotationally symmetrically, relative to the latter. Between adjacent contact pins 36, an angle of 90° is consequently formed, wherein the apex is located on the rotational axis 21. The contact pins are respectively arranged in pairs, diametrically with respect to the axis of rotation 21.

The first disk 22 has a first stationary contact 38, a second stationary contact 40, a third stationary contact 42 and a fourth stationary contact 44 positioned on the surface of the disk body 30 of the first disk 22, facing the second disk 26, which are connected to each of the contact pins 36. Here, each of the stationary contacts 38, 40, 42, 44 is assigned to one of the contact pins 36. The connection of the stationary contacts 38, 40, 42, 44 to the contact pins 36 is effected, for example, by means of welding or soldering.

The first disk 22 further includes a first contact bar 46 having a first section 48 and a second section 50, which are each composed of a copper strip. The two sections 48, 50 electrically contact one another via a bimetallic element 52 (bimetallic snap-disk/bimetallic strip) of the first contact bar 46. The first portion 48 of the first contact bar 46 also electrically contacts the contact pin 36, which is associated with the second stationary contact 40. In other words, the first section 48 electrically contacts the second stationary contact 40. The second section 50 electrically contacts the contact pin 36, which is associated with the third stationary contact 42. Consequently, the second stationary contact 40 and the third stationary contact 42 electrically contact each other by means of the first contact bar 46.

By means of the associated contact pin 36, the first stationary contact 38 electrically contacts a fourth contact bar 54 made of a copper strip, which in turn electrically contacts one of the connectors 18. By means of the associated contact pin 36, the fourth stationary contact 44 electrically contacts a fifth contact bar 56 made of a copper strip, which in turn electrically contacts the remaining connector 18. The contact bars 46, 54, 56 are located, with the exception of the bimetallic element 52, completely on the side of the disk body 30 of the first disk 22, which faces away from the second disk 26, so that an electrical short circuit between these elements and elements of the second disk 26 is ruled out.

The second disk 26 has a first movable contact 58, a second movable contact 60, a third movable contact 62 and a fourth movable contact 64, one of which respectively electrically contact one of the contact pins 36 of the second disk 26 and is connected to said pin. The second disk 26 also includes a second contact bar 66 and a third contact bar 68, which are each formed by a copper strip. The second and third contact bar 66, 68 are positioned on the side of the disk body 32 of the second disk 26 located opposite the first disk 22, wherein said second contact bar 66 electrically contacts the first movable contact 58 and the second movable contact 60 by means of two of the contact pins 36. The third contact bar 68 electrically contacts the contact pins 36 which are associated with the third movable contact 62 and the fourth movable contact 64, so that the third movable contact 62 and the fourth movable contact 64 electrically contact each other by means of the third contact bar 68. The stationary contacts 38, 40, 42, 44 and the movable contacts 58, 60, 62, 64 are similarly designed and are produced from small cylindrical disks made of copper.

The first disk 22 further comprises a first pin 70 on which one of the legs 72 of the leg spring 24 is supported in the assembled state. The second disk 26 also has such a pin 70 on which the remaining leg 72 of the leg spring 24 is supported, so that the second disk 26 is spring-loaded. Further, the second disk 26 has a groove 74 on its circumference, within which the bimetallic element 52 rests in the activated state, i.e., in the electrically conductive state of the circuit breaker 2. Thus, the groove 74 and the bimetal element 52 form a latch 76; hence, the second disk 26 is held rotationally fixed by means of the leg spring 24 in spite of the spring load. The bimetallic element 52 also serves as a current sensor 78. In the event of an overcurrent, the bimetallic element 52 is heated and consequently bent, releasing the latch 76.

The circuit breaker 2 further comprises an actuating mechanism 80 having a cylinder 82, which is guided at its free end, from the housing through an opening 84 of the housing wall 14, which is located substantially opposite the slots 16. At the remaining free end of the cylinder 82, i.e., at the free end which is located within the housing 10, a triangular element 84 is integrally formed, which is supported on a further pin 86 spaced apart from the rotational axis 21. The triangular element 84 is spring-loaded by a spring 88 which is supported on the inner wall of the housing wall 14.

By actuating the actuating mechanism 80, the switching system 4 is placed in an electrically conductive state. For this purpose, the cylinder 82 is pressed into the housing 10 and the second disk 26 is brought into engagement with the bimetallic element 52 against the spring force of the torsion spring 24, so that the latch 76 is established. Consequently, the second disk 26 is moved to a certain angular position, relative to the first disk 22. Here, the first stationary contact 38 rests directly mechanically on the first movable contact 58, the second stationary contact 40 rests directly mechanically on the second movable contact 60, the third stationary contact 42 rests directly mechanically on the third movable contact 62 and the fourth stationary contact 44 rests directly mechanically on the fourth movable contact 64, so that all contacts 38, 40, 42, 44, 58, 60, 62, 64, are electrically connected in series and therefore, an electric current flow is possible between the two connectors 18 via all the contacts 38, 40, 42, 44, 58, 60, 62, 64 via the contact bars 46, 54, 56, 66, 68.

In the event of an overcurrent between the two connectors 18, the overcurrent is detected by the current sensor 78 and the latch 76 is dissolved due to the deformation of the bimetallic element 52, resulting in the second disk 26 being substantially rotated 45° about the axis of rotation 21 as a result of the torsion spring 24. Due to the electrical voltage applied between the two connectors 18, in each case an arc is formed between the first stationary contact 38 and the first movable contact 58, and between the second movable contact 60 and the second stationary contact 40, and between the third stationary contact 42 and the third movable contact 62, and between the fourth movable contact 64 and the fourth stationary contact 44. These are connected in series to each other, and therefore, the electrical voltage required for the formation and maintenance of the arcs is relatively high. In addition, due to the relatively large number of contact points of arcs with one of the contacts 38, 40, 42, 44, 58, 60, 62, 64, a comparatively large contact voltage is present which further increases the arc voltage. Further, because of the increase of the respective arcs due to the rotational movement, the distance between respective mutually associated contacts is increased, which further increases the arc voltage. Also, the arcs are in direct contact with the disk bodies 30, 32 of the first and second disks 22, 26, which cools them and, consequently, increases the electrical resistance, which leads to a further increase in arc voltage.

Due to the rotational movement, it is possible to design the circuit breaker 2 relatively flat, wherein furthermore the current sensor 78 is not used directly as an actuator for the contact opening, which is why said sensor is not damaged by the resulting melting loss. Rather, the current sensor 78 is only used to release the latch 76.

Figure 3:
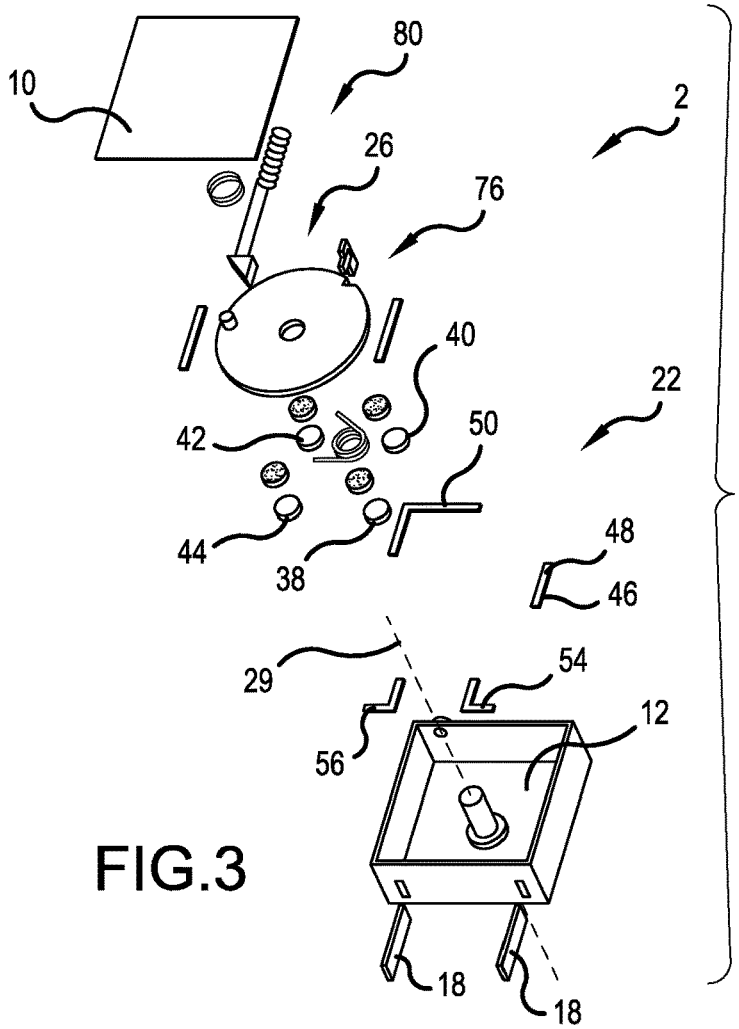
FIG. 3 illustrates a circuit breaker.

FIG. 3 shows a further embodiment of the circuit breaker 2 in an exploded view, wherein only the first disk 22 has been modified. The second disk 26, the latch 76 and the actuating mechanism 80, however, have been left unchanged, as well as the connectors 18. The first disk 22 is formed by means of the housing bottom 12 which takes over the function of the disk body 30, which is not provided. The first contact bar 46 with the two sections 48, 50 and the fourth contact bar 54 and the fifth contact bar 56 are directly connected to the housing bottom 12. The stationary contacts 38, 40, 42, 44 are electrically contacted directly with the respective contact bars 46, 54, 56 and connected thereto with their free end. As a result, the axial overall height, i.e., the dimension of the circuit breaker 2 along the rotational axis 21, is reduced, as well as the number of required parts.

Figure 4:
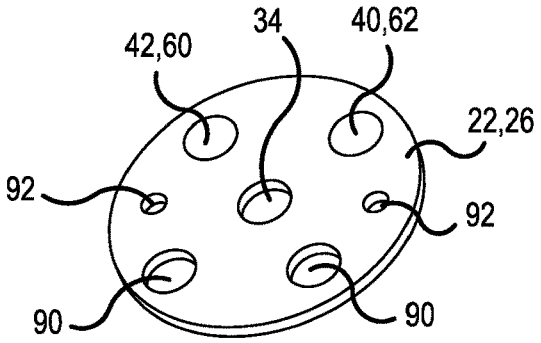
FIG. 4 is a perspective view of a first disk of a circuit breaker.

FIG. 4 shows a further embodiment of the first disk 22, which is particularly preferably similarly designed to the second disk 26. The disk body 30 of the first disk 22 and the disk body 32 of the second disk 26 have four recesses 90 in place of the contact pins 36, within which the respective contacts 38, 40, 42, 44, 58, 60, 62, 64 are positively positioned, of which in this case only the second and third stationary contact 40, 42 and the second and third movable contact 60, 62 are shown. The contacts 38, 40, 42, 44, 58, 60, 62, 64 are flush with the surface facing the respective other disk 22, 26 so that the disks 22, 26 have a planar surface on this side. Also, the pin 70 is omitted.

The leg spring 24 is located on the side of the other pin 86 of the second disk 26 and is, for example, supported on the cover 6. The first disk 22 also has two bores 92 that are radially outwardly offset relative to the central recess 34, within which projections engage which are not shown and which are integrally formed on the housing bottom 12 so that the first disk 22 is held rotationally fixed. The bores 92 are, for example, not provided in the second disk 26, or, if identical parts are used, no further components are inserted in the assembled state. In the embodiment shown in FIG. 1, the bores 92 are also provided.

The invention is not limited to the exemplary embodiments described above. Rather, other variations of the invention can be derived therefrom by those skilled in the art without departing from the scope of the invention. In particular, all individual features described in connection with the various embodiments may also be combined in other ways without departing from the scope of the invention.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A switching system for an on-board electrical system of a motor vehicle, the system comprising:

a first disk having a first stationary contact and a second stationary contact and a third stationary contact and a fourth stationary contact, the second stationary contact and the third stationary contact electrically contact each other via a first contact bar of the first disk; and a second disk having a first movable contact and a second movable contact and a third movable contact and a fourth movable contact, the first movable contact and the second movable contact electrically contact each other via a second contact bar of the second disk, the third movable contact and the fourth movable contact electrically contact each other via a third contact bar of the second disk, wherein the second disk is rotationally mounted about a rotational axis relative to the first disk, and wherein the second disk is spring-loaded via a leg spring.

2. The switching system according to claim 1, wherein the rotational axis is substantially perpendicular to the second disk or wherein the first disk is substantially parallel to the second disk.

3. The switching system according to claim 1, wherein the second disk comprises a disk body, wherein the second contact bar and the third contact bar are positioned on a side of the disk body located opposite the first disk, and/or wherein the movable contacts are arranged in recesses of the disk body.

4. The switching system according to claim 1, further comprising a housing comprising a housing shell and a housing cover, and within which the first and the second disk are positioned.

5. The switching system according to claim 4, wherein the first disk is formed by the housing shell.

6. The switching system according to claim 4, wherein the housing shell has an axis journal on which the second disk is mounted.

7. A circuit breaker, comprising:

a switching system according to claim 1; and a current sensor.

8. The switching system according to claim 1, wherein each stationary contact is disposed rotationally symmetrical at 90° with respect to an adjacent one of the stationary contacts.

9. The switching system according to claim 1, wherein each of the stationary contacts and each of the movable contacts comprise cylindrical copper disks.

10. A switching system for an on-board electrical system of a motor vehicle, the system comprising:

a first disk having a first stationary contact and a second stationary contact and a third stationary contact and a fourth stationary contact, the second stationary contact and the third stationary contact electrically contact each other via a first contact bar of the first disk;

a second disk having a first movable contact and a second movable contact and a third movable contact and a fourth movable contact, the first movable contact and the second movable contact electrically contact each other via a second contact bar of the second disk, the third movable contact and the fourth movable contact electrically contact each other via a third contact bar of the second disk; and a latch for the second disk, wherein the second disk is rotationally mounted about a rotational axis relative to the first disk.

11. A switching system for an on-board electrical system of a motor vehicle, the system comprising:

a first disk having a first stationary contact and a second stationary contact and a third stationary contact and a fourth stationary contact, the second stationary contact and the third stationary contact electrically contact each other via a first contact bar of the first disk; and a second disk having a first movable contact and a second movable contact and a third movable contact and a fourth movable contact, the first movable contact and the second movable contact electrically contact each other via a second contact bar of the second disk, the third movable contact and the fourth movable contact electrically contact each other via a third contact bar of the second disk, wherein the second disk is rotationally mounted about a rotational axis relative to the first disk, and wherein the first contact bar comprises a first section and a second section, the first section and the second section each comprising a copper strip.

12. The switching system according to claim 11, wherein the first section and the second section contact each other via a bimetallic element.

13. The switching system according to claim 11, wherein the first section electrically contacts a contact pin associated with the second stationary contact.

14. A switching system for an on-board electrical system of a motor vehicle, the system comprising:

a first disk having a first stationary contact and a second stationary contact and a third stationary contact and a fourth stationary contact, the second stationary contact and the third stationary contact electrically contact each other via a first contact bar of the first disk;

a second disk having a first movable contact and a second movable contact and a third movable contact and a fourth movable contact, the first movable contact and the second movable contact electrically contact each other via a second contact bar of the second disk, the third movable contact and the fourth movable contact electrically contact each other via a third contact bar of the second disk; and four contact pins embedded in each of the first disk and the second disk, wherein the second disk is rotationally mounted about a rotational axis relative to the first disk.

15. The switching system according to claim 14, wherein the contact pins are made of an electrically conductive material.

16. The switching system according to claim 14, wherein the first stationary contact, the second stationary contact, the third stationary contact and the fourth stationary contact are each connected to one of the contact pins.

17. The switching system according to claim 14, wherein each of the contact pins is disposed rotationally symmetrical at 90° with respect to an adjacent one of the contact pins.

18. A switching system for an on-board electrical system of a motor vehicle, the system comprising:

a first disk comprising:

a first stationary contact, a second stationary contact, a third stationary contact;

a fourth stationary contact; and a first contact bar electrically contacting the second stationary contact to the third stationary contact; and a second disk, comprising:

a first movable contact;

a second movable contact;

a third movable contact;

a fourth movable contact;

a second contact bar electrically contacting the first movable contact to the second movable contact; and a third contact bar electrically contacting the third movable contact to the fourth movable contact, wherein the second disk is rotationally mounted about a rotational axis relative to the first disk, wherein the second disk is spring-loaded via a lea spring.

* * * * *